US008161570B2

(12) United States Patent
McVeigh et al.

(10) Patent No.: US 8,161,570 B2
(45) Date of Patent: Apr. 24, 2012

(54) CATCHING GEAR WITH APPARATUS FOR INCREASING HAND SIGNAL VISIBILITY

(75) Inventors: James McVeigh, Tarrytown, NY (US); James Patrick Quinn, White Plains, NY (US); Robert D. Doss, Defiance, MO (US); Steven R. Remy, New York, NY (US)

(73) Assignee: Sign Brite Inc., Tarrytown, NY (US)

( * ) Notice: Subject to any disclaimer, the term of this patent is extended or adjusted under 35 U.S.C. 154(b) by 310 days.

(21) Appl. No.: 12/566,262

(22) Filed: Sep. 24, 2009

(65) Prior Publication Data

US 2010/0138971 A1 Jun. 10, 2010

Related U.S. Application Data

(60) Provisional application No. 61/120,099, filed on Dec. 5, 2008.

(51) Int. Cl.
*A41D 13/00* (2006.01)

(52) U.S. Cl. ..... 2/24

(58) Field of Classification Search ..... 2/455, 227, 2/79, 62, 24, 911, 22, 23, 159; 73/379.01; 273/317.6, 317.7, 333; 473/454, 455, 456
See application file for complete search history.

(56) References Cited

U.S. PATENT DOCUMENTS 2,506,685 A 5/1950 Sadloski
5,056,158 A 10/1991 Lutz
5,448,458 A 9/1995 Smyly, Jr.
5,553,846 A * 9/1996 Frye et al. ..... 473/455
5,588,919 A * 12/1996 Nakamura ..... 473/212
5,688,038 A 11/1997 Chien
5,716,120 A 2/1998 Hung
5,833,549 A * 11/1998 Zur et al. ..... 473/199
6,062,700 A 5/2000 Price
6,168,286 B1 1/2001 Duffy
6,659,618 B2 12/2003 Waters
6,721,962 B1 4/2004 Polaire
6,892,397 B2 5/2005 Raz
6,895,602 B2 5/2005 Schlapkohl
6,964,493 B1 11/2005 Whitlock
6,991,342 B2 1/2006 Gonet
7,111,956 B2 9/2006 Brown
(Continued)

FOREIGN PATENT DOCUMENTS

GB 2448678 A 10/2008
(Continued)

OTHER PUBLICATIONS

International Search Report mailed Feb. 3, 2010 regarding PCT/US2009/066300, 3 pages.

(Continued)

*Primary Examiner* — Tejash Patel
(74) *Attorney, Agent, or Firm* — Senniger Powers LLP

(57) ABSTRACT

Catching gear to be worn by a catcher receiving a ball from a pitcher is disclosed. The gear comprises a leg guard adapted to be worn on one leg of the catcher, and a light-emitting device on the leg guard. The light-emitting device is positioned for generating light to be directed toward the catcher's fingers to increase the visibility of hand signals given by the catcher.

26 Claims, 18 Drawing Sheets

U.S. PATENT DOCUMENTS

| | | | | |
|---|---|---|---|---|
| 7,152,470 | B2 * | 12/2006 | Impio et al. | 73/379.01 |
| 7,192,152 | B1 | 3/2007 | Hesse | |
| 7,470,202 | B1 * | 12/2008 | Lewis | 473/454 |
| 2004/0100792 | A1 | 5/2004 | Trzecieski | |
| 2004/0255490 | A1 | 12/2004 | Wan | |
| 2005/0063200 | A1 | 3/2005 | Lu | |

FOREIGN PATENT DOCUMENTS

| | | | |
|---|---|---|---|
| WO | 2007071251 | A1 | 6/2007 |

OTHER PUBLICATIONS

HALFBAKERY, Knee Lights, 2 web pages.

* cited by examiner

CATCHING GEAR WITH APPARATUS FOR INCREASING HAND SIGNAL VISIBILITY

CROSS-REFERENCE TO RELATED APPLICATION

This application is a divisional of U.S. Patent Application No. 61/120,099, filed Dec. 5, 2008, which is hereby incorporated by reference in its entirety.

FIELD OF THE INVENTION

The present invention generally relates to athletic gear and, more particularly, to gear worn by a catcher receiving a baseball or softball from a pitcher.

BACKGROUND OF THE INVENTION

During any baseball (or softball) game, the most common way for the catcher to relay a sign to the pitcher is to use the fingers of his throwing hand which is hidden between his legs to conceal it from the opposing team. The hand signal is given from a squatting position and the hand is positioned between the legs and as close as possible to the catcher's crotch area in order for it to be hidden from the opposing team's base coaches and base runners. One drawback to positioning the hand signals deep between the catcher's legs is that during night games or at dusk, shadows are created between his legs and the signals become more difficult for the pitcher to see and understand. The clarity of the catcher's signals is diminished during day games as well, when direct sunlight creates a shadow over the catcher, thus creating a dark background in the signal area. The color of the catcher's equipment, specifically dark colored equipment, may also hinder the visibility of the signals.

SUMMARY OF THE INVENTION

In general, this invention relates to catching gear to be worn by a catcher receiving a ball from a pitcher. The gear comprises a leg guard adapted to be worn on one leg of the catcher, and apparatus comprising a light-emitting device on the leg guard positioned for generating light to be directed toward the catcher's fingers to increase the visibility of hand signals by the catcher to the pitcher when the catcher is in a crouch position.

In another aspect, this invention relates to light-emitting apparatus to be worn by a catcher receiving a ball from a pitcher. The light-emitting apparatus comprises a housing, a light-emitting device in or on the housing for generating light for increasing the visibility of hand signals by the catcher to the pitcher, and an attachment device for attaching the housing to a leg of the catcher or to a leg guard worn by the catcher such that the housing is in a position in which the light from the light-emitting device is emitted toward the catcher's fingers to increase the visibility of hand signals by the catcher to the pitcher when the catcher is in a crouch position.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
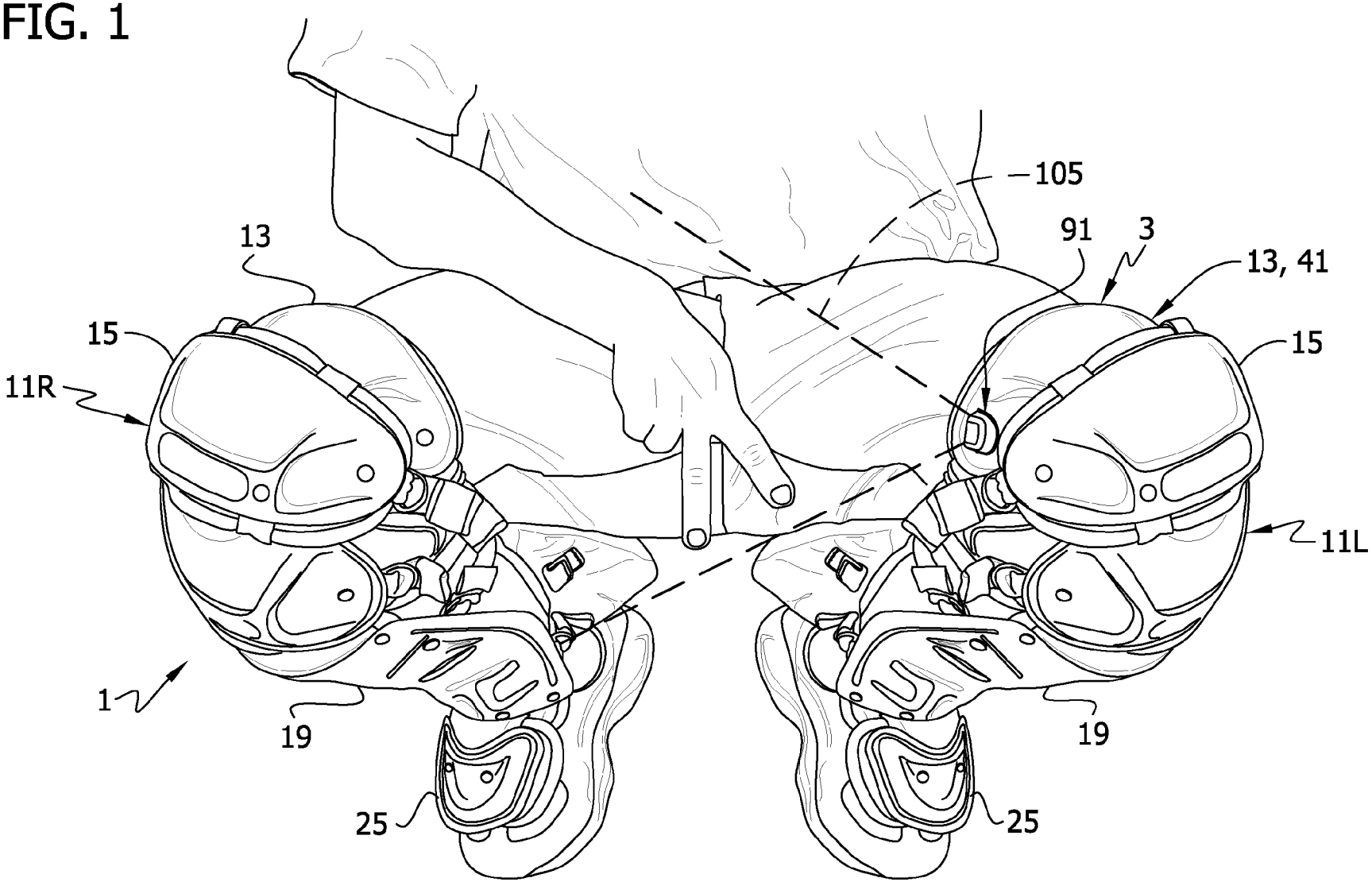
FIG. 1 is a perspective view showing a catcher in a crouch position wearing catching gear incorporating one embodiment of light-emitting apparatus of this invention.

Referring to the drawings, there is generally indicated at 1 catching gear incorporating light-emitting apparatus of this invention, generally designated 3. The gear comprises two leg guards, e.g., right leg guard 11R and left leg guard 11L, for attachment to the legs of a catcher. Each leg guard has a number of sections, including a thigh section 13, a knee section 15, a shin section 19 and (optionally) a foot section 25, all suitably connected by hinge members to allow pivoting of the various sections relative to one another. Each of the knee, shin and foot sections is of conventional construction and comprises an outer shell of substantially rigid material (e.g., molded plastic) and an inner liner of cushioning material secured to the shell. The leg guards 11R, 11L are secured to the leg of a catcher by straps or other means.

In general, the light-emitting apparatus 3 comprises a housing 41 on one of the leg guards 11R, 11L for enclosing various components of the apparatus, including a light-emitting device 43. As illustrated in FIG. 1, the light-emitting device is on the left leg guard 11L of the catching gear, but it will be understood that the device could be on the right leg guard 11R. Further, separate light-emitting devices can be provided on both leg guards. In any event, each such light-emitting device 43 is positioned for increasing the visibility of hand signals by the catcher when the catcher is in a (crouch) position, as shown in FIG. 1. In this embodiment, the apparatus 3 also includes a mount 45 for mounting the light-emitting device in the housing 41, a sensor 47 for sensing movement of the catcher, a control system 49 responsive to signals from the sensor for controlling operation of the light-emitting device 43, and a power supply 51 for the light-emitting device and control system. The components of the light-emitting apparatus 3 are described in more detail below.

Figure 2:
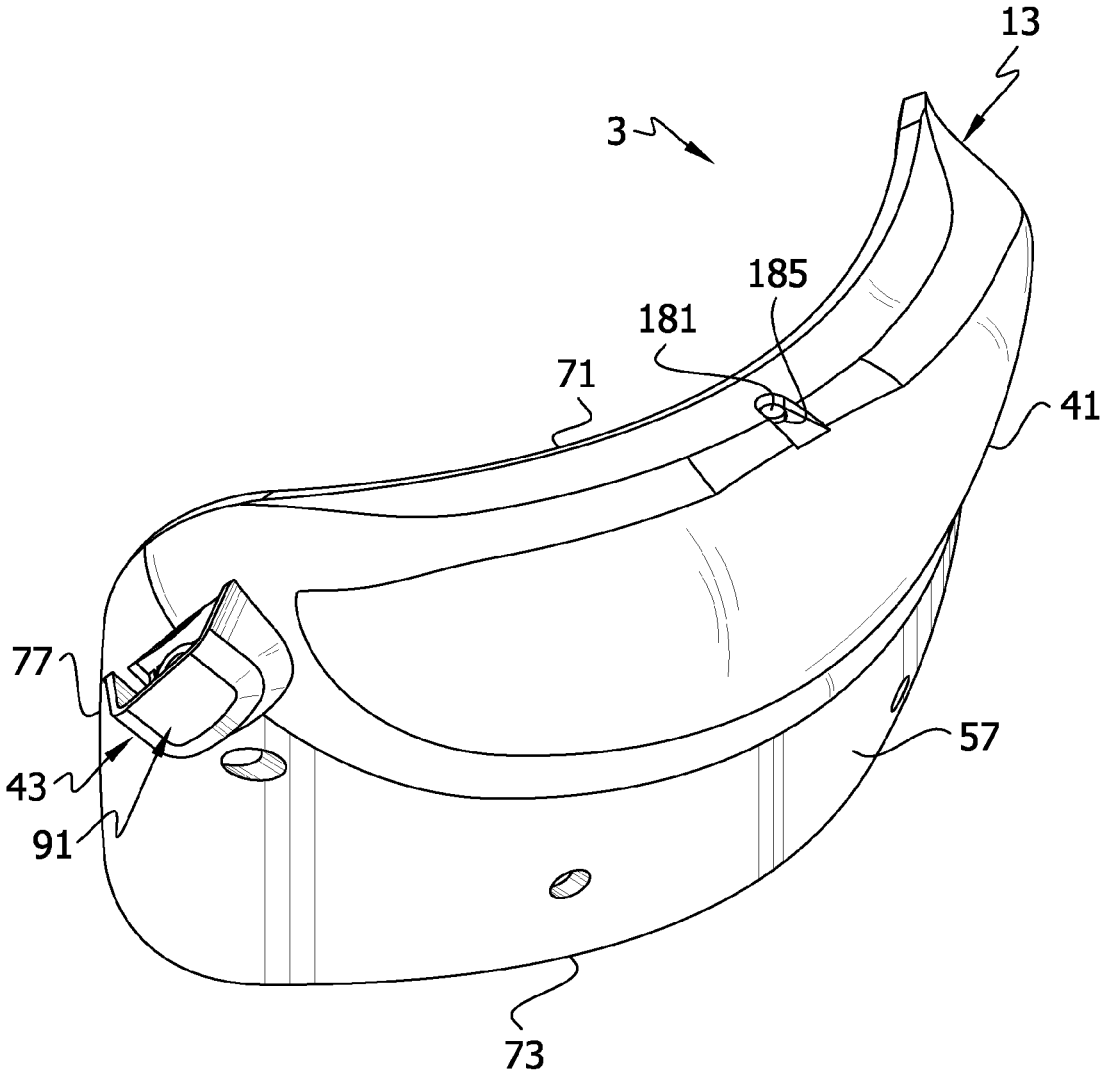
FIG. 2 is a front perspective of a thigh section of a leg guard of the catching gear of FIG. 1 housing the light-emitting apparatus.
Figure 3:
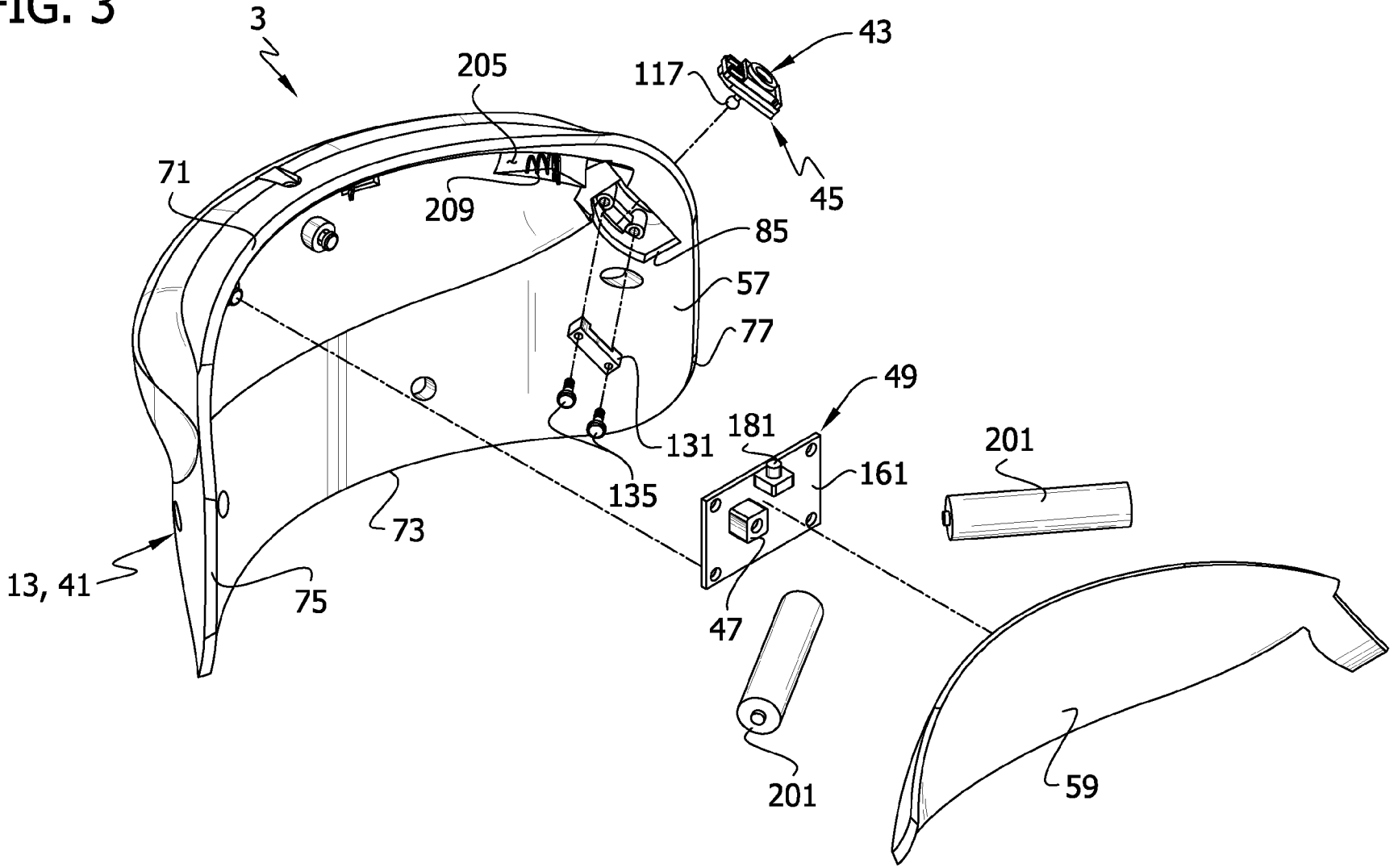
FIG. 3 is an exploded rear perspective of the thigh section showing various components of the light-emitting apparatus, including a light-emitting device, a mount for the light-emitting device, a power supply and a control system.

Referring to FIGS. 2 and 3, the light-emitting device 43 is contained in the thigh section 13 of the left leg guard 11L. It will be understood that the device 43 can be mounted at other locations on the leg guard (e.g., on the shin section). The thigh section includes an outer shell 57 and an inner liner 59 attached in a releasable manner to the back of the outer shell. The outer shell and inner liner are of substantially rigid material (e.g., molded plastic) and combine to form the housing 41 for components of the light-emitting apparatus. The inner liner 59 is releasable from the outer shell to provide access to these components. For example, the inner liner 59 may be attached by suitable fasteners to the outer shell 57 for easy removal from the shell. An additional layer of padding (not shown) may be added on the rear surface of the inner liner to increase comfort, if desired. The inner liner 59 can be fabricated as more than one part (e.g., upper and lower parts).

As illustrated in FIG. 3, the outer shell 57 of the thigh section 13 is generally concave and shaped to fit over the top of the leg at the thigh. It has an upper edge 71, a lower edge 73 and left and right sides 75, 77 (as viewed by the catcher). An opening 85 is provided in the outer shell 57 generally adjacent its right side 77 for receiving the light-emitting device 43 and the mount 51. A protective hood 91 on the outer shell 57 overlies the opening and the light-emitting device 43. The hood 91 overlies the light-emitting device and substantially shields it from view so that it is not a distraction to, for example, the catcher, an umpire, a batter and other players. The hood 91 is also of a substantially rigid material and may be formed (e.g., molded) as an integral part of the outer shell. The hood 91 has a generally U-shaped side wall 95, a top wall 99 and an opening 101 through which light from the light-emitting device 43 is directed for illuminating or otherwise increasing the visibility of the hand signals of the catcher. Desirably, a light-transmitting lens (not shown) of plastic or other suitable material covers the opening 101 for protecting the LED device under the hood.

The housing 41 is desirably constructed to withstand the impact of a baseball or a player hitting it. Further, it should protect the light-emitting device 43 and related components from dirt and components when the catcher drops to a knee to block a pitch or the plate. It is also desirable that the housing be weather (e.g., water) resistant to protect the components from environmental weather conditions. The housing 41 is secured to the thigh and/or to the catcher's gear by suitable means, such as by one or more straps having releasable fasteners.

In one embodiment, the light-emitting device 43 comprises an ultra-bright LED (light-emitting diode), also designated 43, capable of emitting an amount of light sufficient to illuminate or otherwise increase the viability of a catcher's hand signals so that they may be seen more clearly by a pitcher throwing a ball to the catcher when the catcher is in a signal-giving crouch position. By way of example but not limitation, the LED may emit a beam 105 of light having a viewing (divergence) angle of 110 degrees. Desirably, the color of the light is white (natural color) for blending into the light illuminating the field of play. Alternatively, the light may have other colors. Still further, the light emitted may be a non-visible light (i.e., light not visible to the naked eye, such as black ultraviolet light) capable of illuminating a marker (such as a florescent nail polish) on the catcher's hand or on some other article (e.g., a glove) worn on the hand of the catcher.

The mount 45 for the LED 43 comprises a swivel support 115 having a swivel ball 117 received in a socket formation 121 on the inner surface of the outer shell 57 of the thigh section 13. The swivel ball 117 is held in place by a clamp 131 secured to the socket formation 121 by removable fasteners 135. This arrangement allows the clamp 131 to be removed so that the LED subassembly (LED 43 and swivel support 115) can be easily removed from the housing 41 for repair and/or replacement. The swivel ball 117 allows the position of the LED 43 to be adjusted manually in virtually any direction so that the beam of light 151 generated by the LED 43 is directed toward the area where the hand signals are given, which is typically the crotch or cup area when the catcher is in a signal-giving (crouch) position. Other mounts can be used for the LED, including mounts which provide for linear adjustment only, and or for mounting the LED in a fixed non-adjustable position.

The sensor 47 is for sensing movement of the catcher into an "active" zone corresponding to a crouch position in which the catcher is positioned for giving hand signals to a pitcher. The sensed position is preferably a three-dimensional position, but it may be a two-dimensional position. The control system 49 is responsive to signals from the sensor 47 to control the operation of the light-emitting device 43 (e.g., LED). In one exemplary embodiment, the sensor 47 is a 3-axis accelerometer mounted on a control board 161 affixed by suitable fasteners 165 to the inner surface of the outer shell 57 of the thigh section 13 of the leg guard. The sensor is operable to sense the angle of the catcher's upper leg or thigh. Because the sensor 47 is a 3-axis device, the angle of the catcher's thigh can be detected in X, Y and Z axes corresponding to up and down movement, forward and rearward movement, and lateral or side-to-side movement, respectively. By sensing the various angles of the thigh, the control system 49 is able to make decisions as to the catcher's movements and body positions for the purpose of knowing when to turn the light-emitting device 43 on and/or off. One suitable 3-axis accelerometer is commercially available from Freescale Semiconductor, Inc. in Tempe, Ariz., under product number MMA7260QT. A technical data sheet for this product is attached as an appendix to this specification and incorporated herein by reference.

Referring to FIGS. 8A-8D, the control system 49 comprises a controller 175 such as a programmed microcontroller integrated chip mounted on the control board 161. The controller 175 reads the output of the sensor 47 and is programmed with a control alogorithm (described later) to determine when to turn on the LED 43. Low-pass filtering of the X, Y, and Z outputs of the sensor 47 by component pairs R4/C5, R5/C4 and R6/C3, respectively, provides respective DC signals to the controller 175. The voltages of these signals are proportional to the tilt angle. The voltages are converted to a numeric value by way of an analog-to-digital converter (ADC) contained within the controller. It is these three numeric values that are used to determine the position of the catcher's leg.

The control system 49 also includes a manually operated switch 181 mounted on the control board 161. The switch 181 is provided as a user interface to the controller and, in one embodiment, comprises a push-button switch which is readily accessible by the catcher through an opening 185 (FIG. 4) in the outer shell 57. A suitable seal (e.g., gasket) is provided for sealing the opening 185 around the switch 181 to improve water resistance.

The controller 175 is programmed with a software control algorithm used to control the operation of the light-emitting apparatus 3. A significant function of the algorithm is to determine when to turn on the LED 43. During the course of a baseball game, the catcher will be involved in different activities. These might include sitting in the dugout and moving about while waiting to resume his catching responsibilities behind the plate. Once on the field, the catcher will be making many different moves ranging from squatting down in position to catch the pitch to running toward catching a fly ball. The control algorithm uses the sensor 47 to make decisions as to the catcher's activity. Signals from the sensor 47 are read by the controller 175, and when the catcher enters the "active" zone, i.e., a catching position, the controller turns on the light-emitting device.

The balance of the control algorithm relates to adjusting the brightness of the light-emitting device and automatic power-down. Both of these features are described later.

Figure 4:
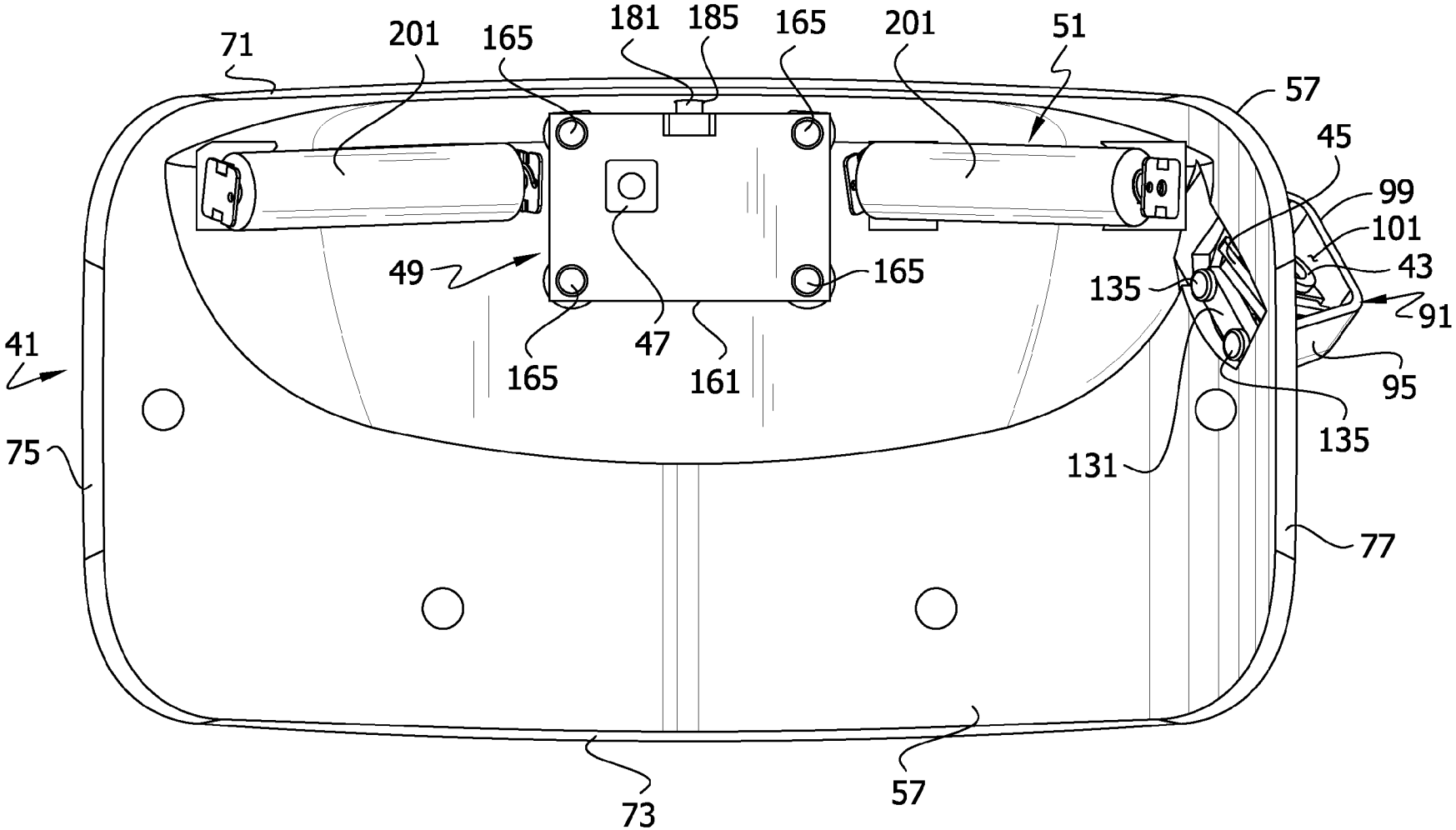
FIG. 4 is a rear elevation of the thigh section with an inner liner removed to show details of the light-emitting apparatus.
Figure 5:
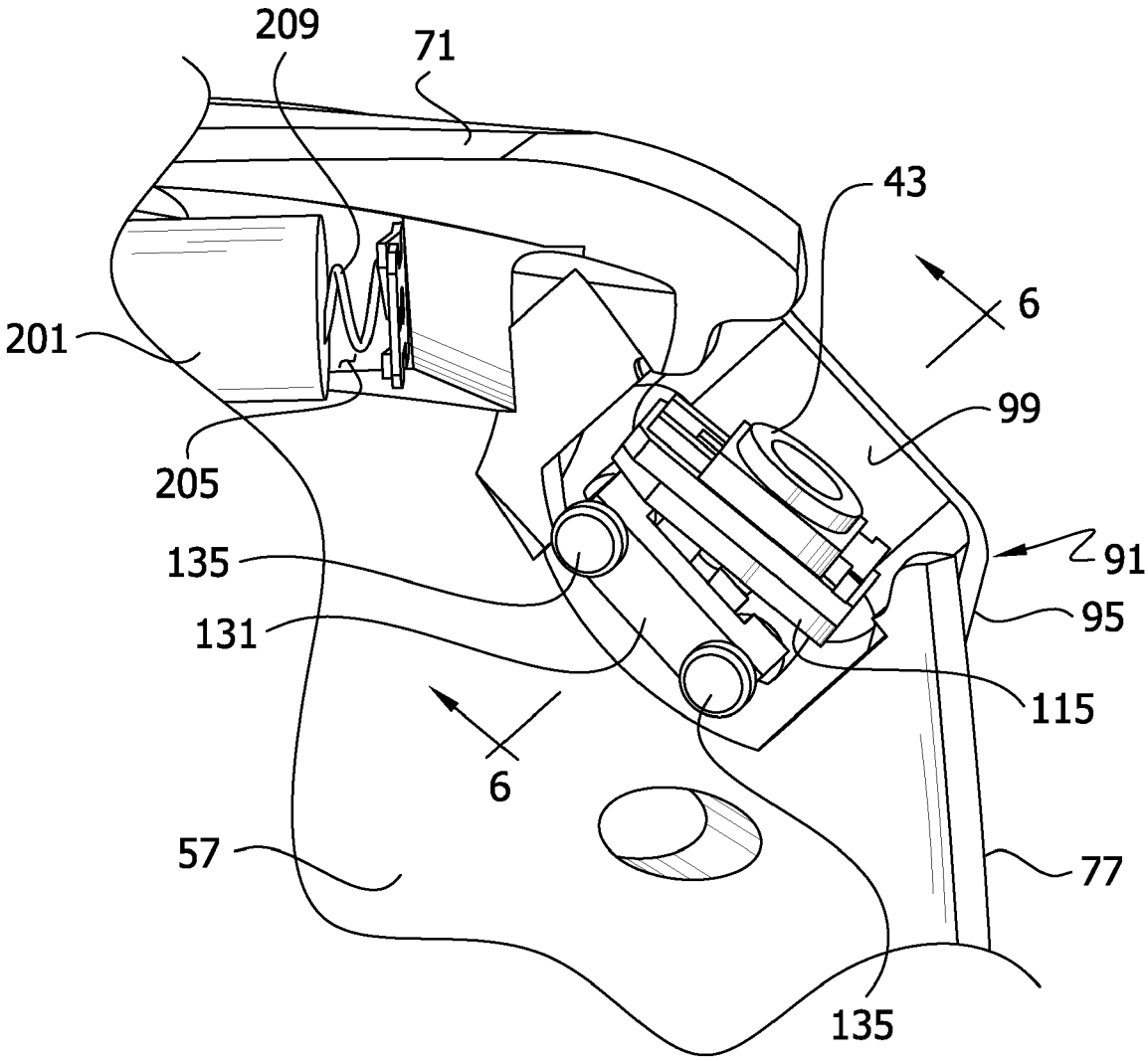
FIG. 5 is a rear perspective of a portion of the thigh section showing one embodiment of the light-emitting device.
Figure 6:
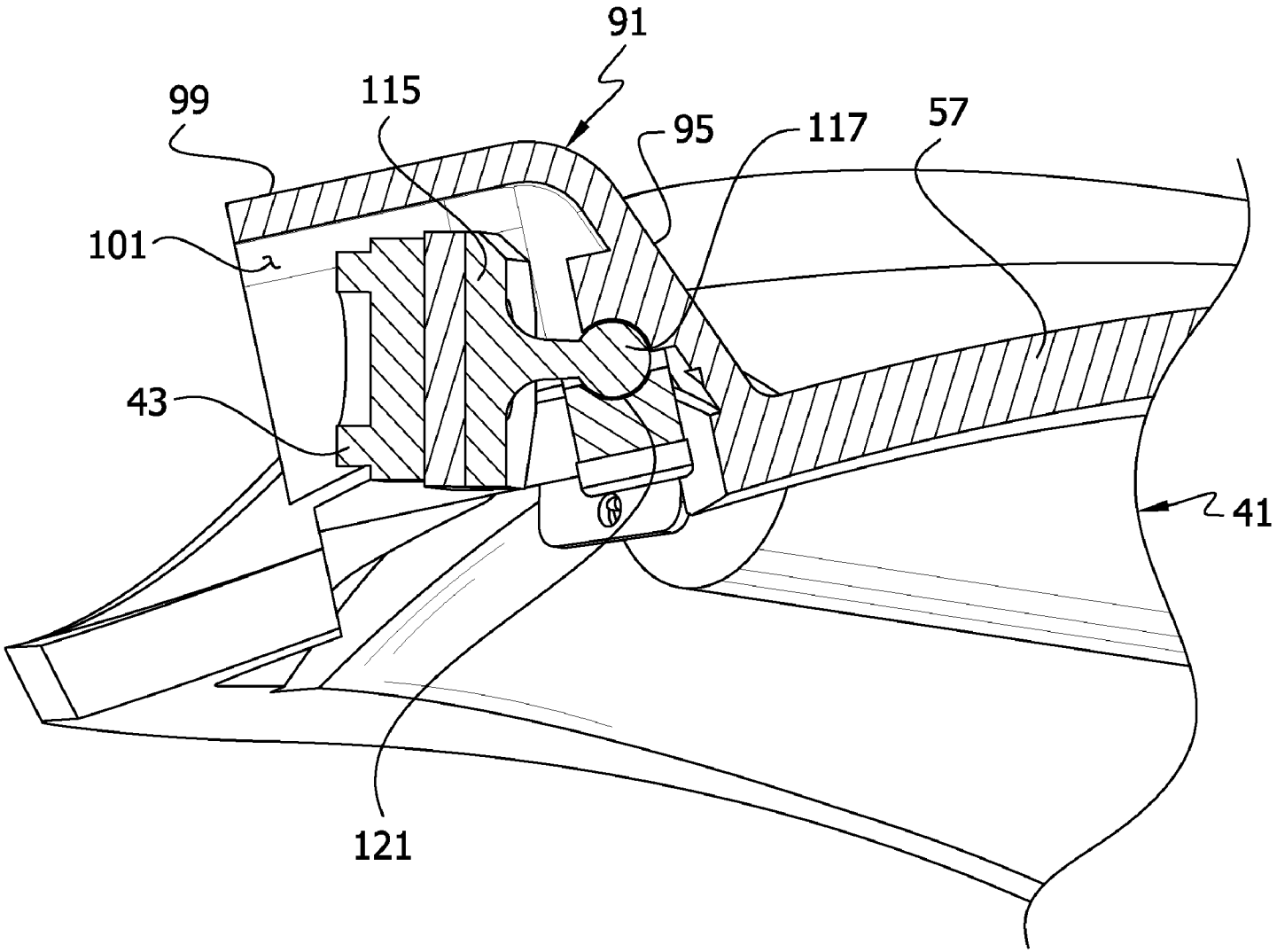
FIG. 6 is a section taken on lines 6-6 of FIG. 5.
Figure 7:
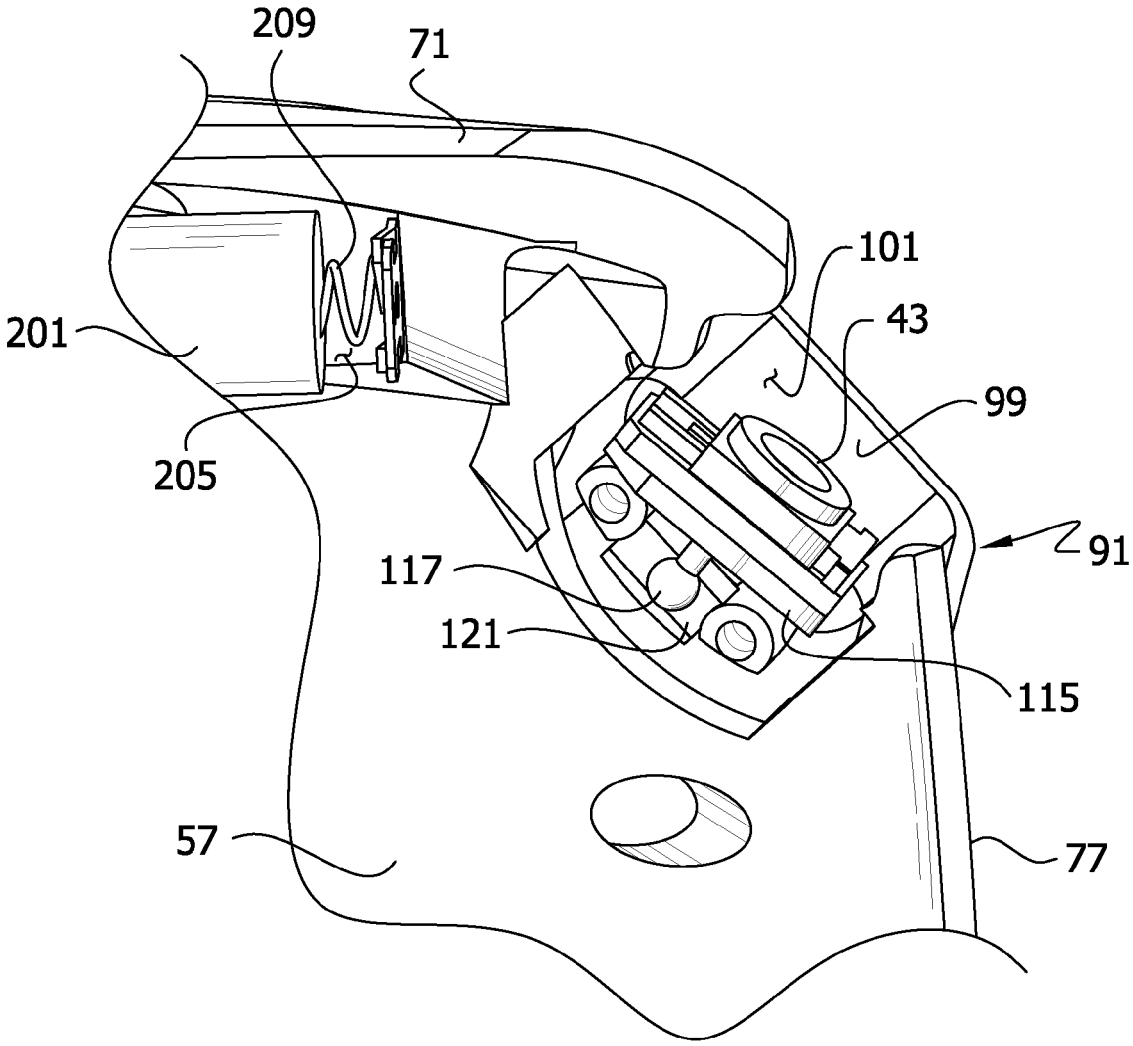
FIG. 7 is a view similar to FIG. 5 but with a clamp removed to show details of the of the light-emitting device and mount.
Figure 8A:
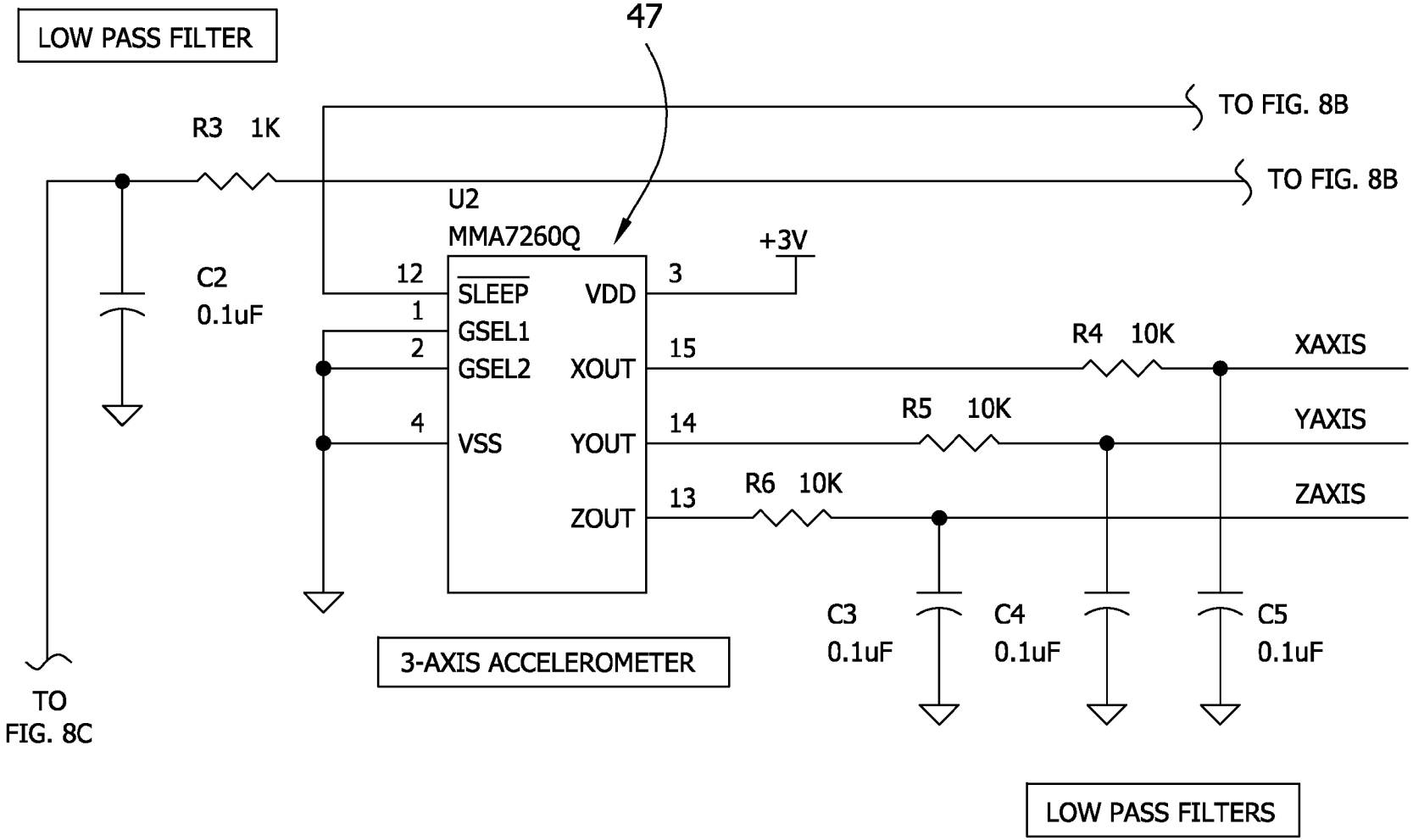
FIGS. 8A-8D are segments of an electrical schematic showing a circuit of the control system.
Figure 8B:
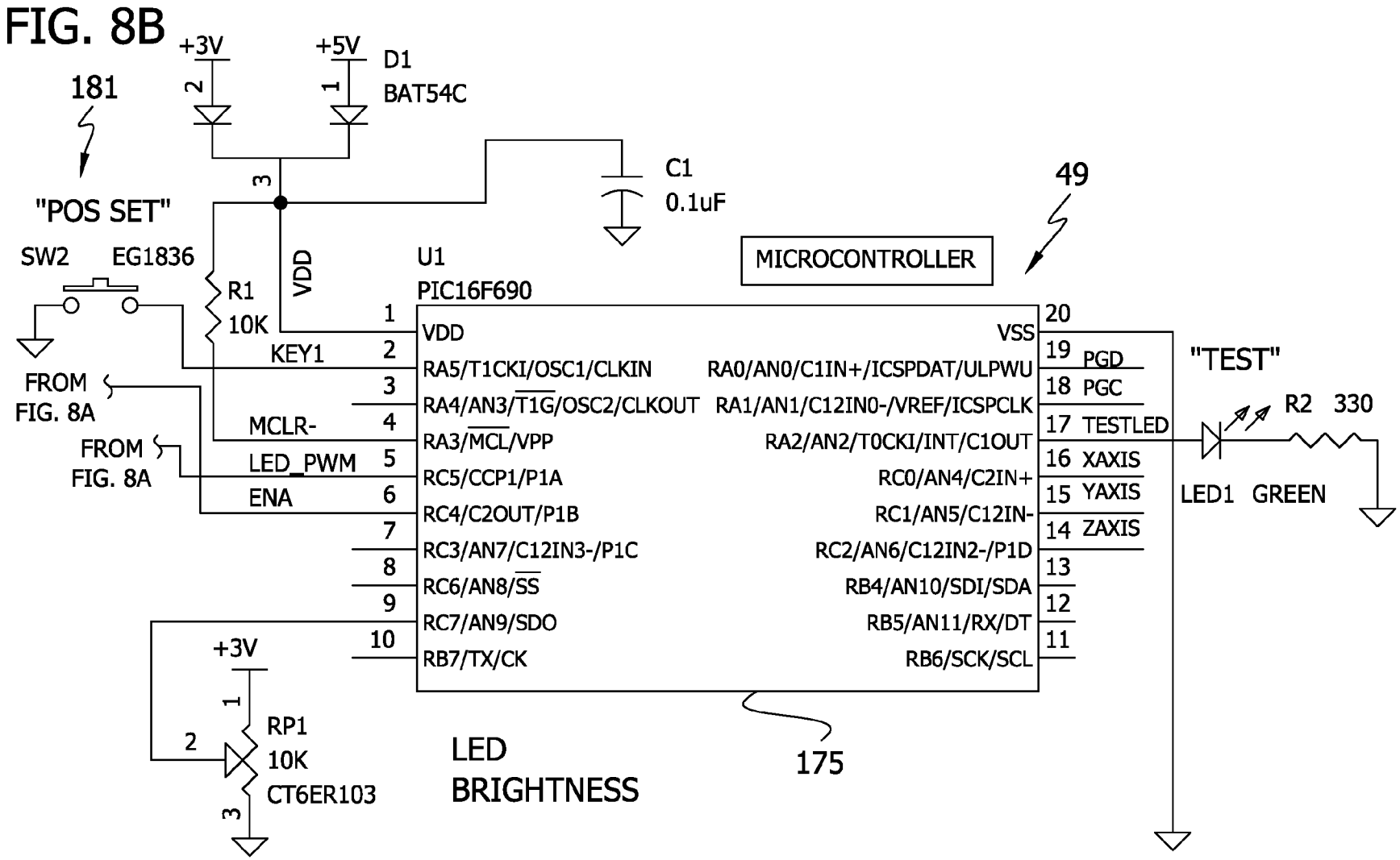
Figure 8C:
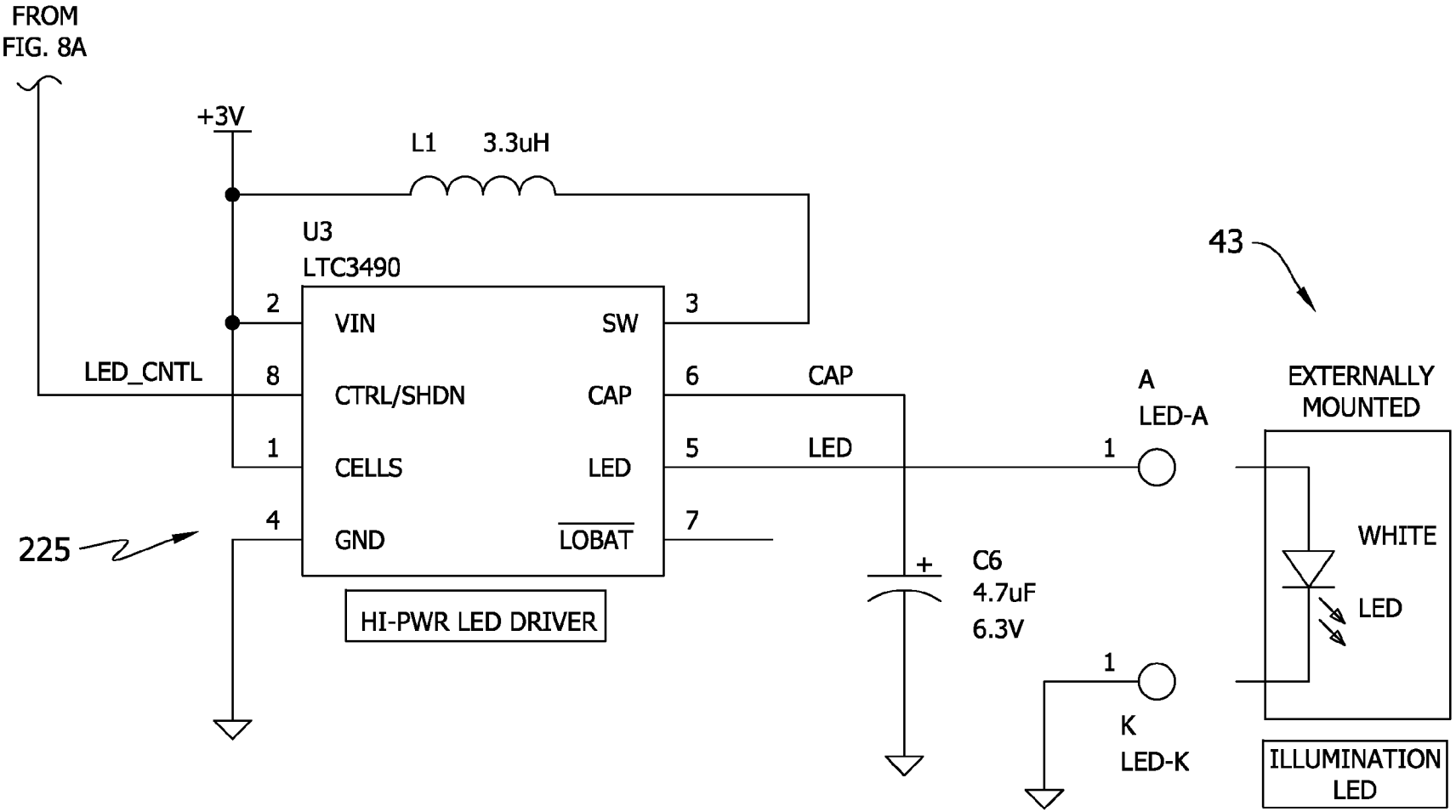
Figure 8D:
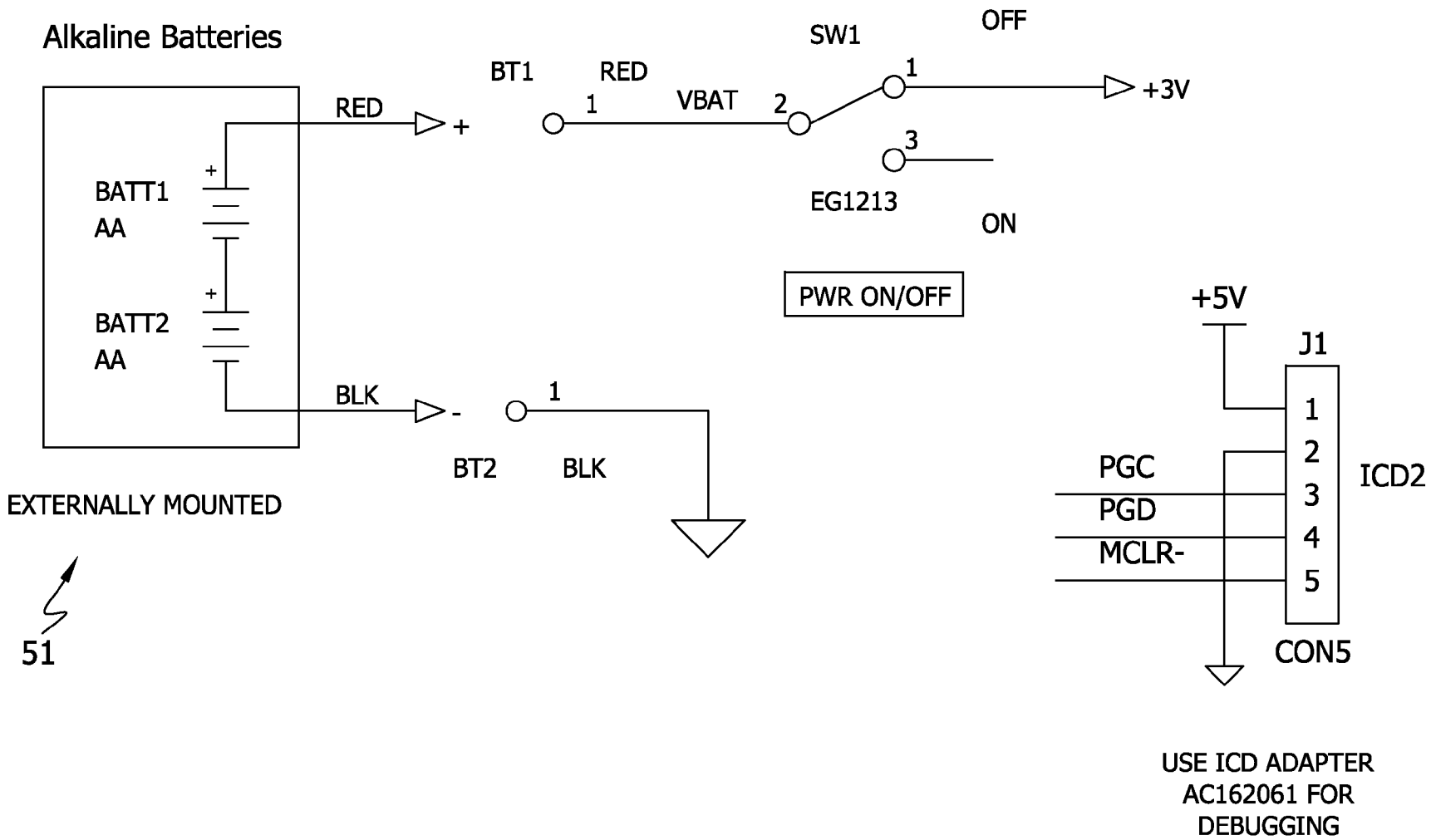
Figure 9A:
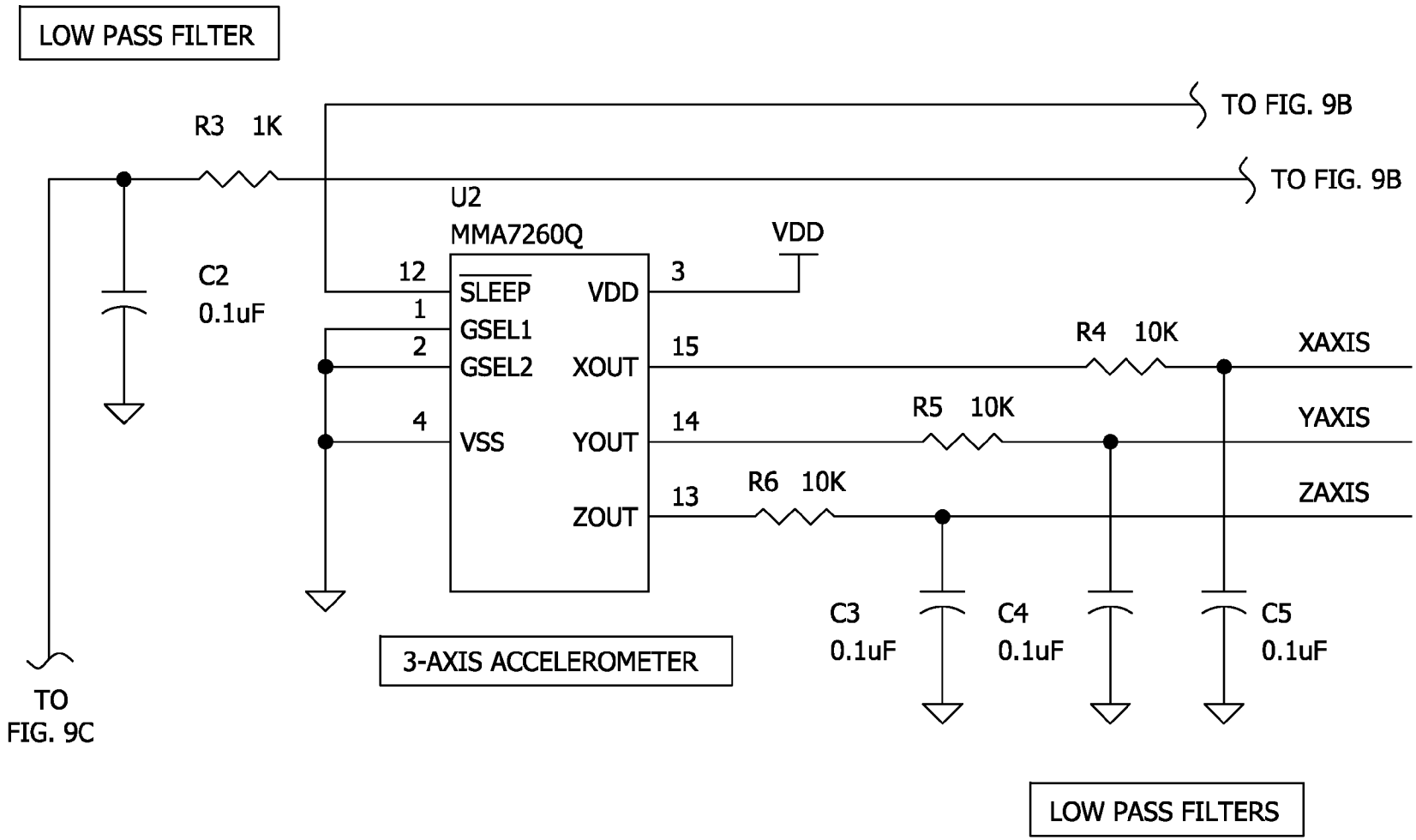
FIGS. 9A-9D are segments of an electrical schematic showing an alternative circuit similar to that shown in FIGS. 8A-8D.
Figure 9B:
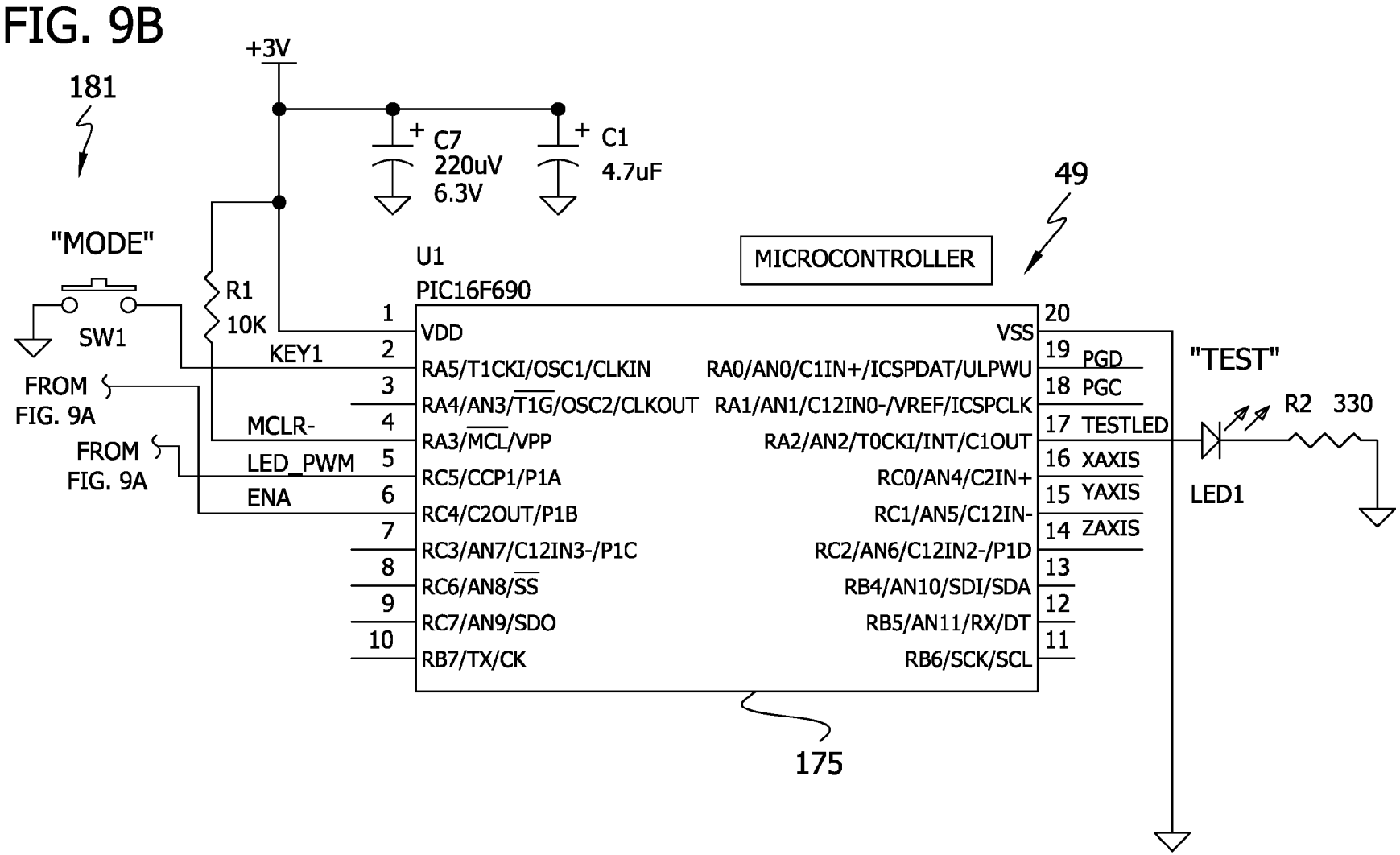
Figure 9C:
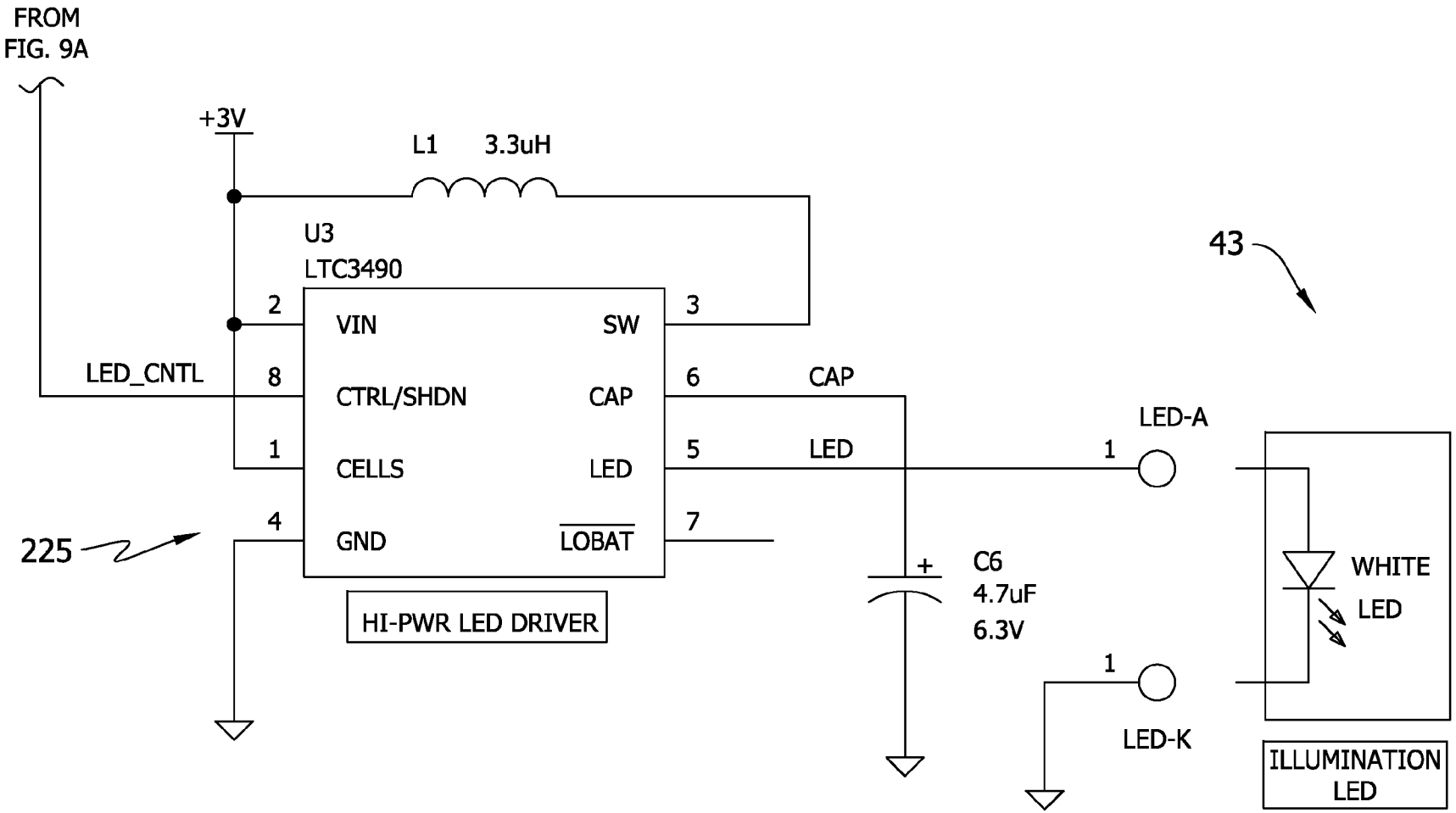
Figure 9D:
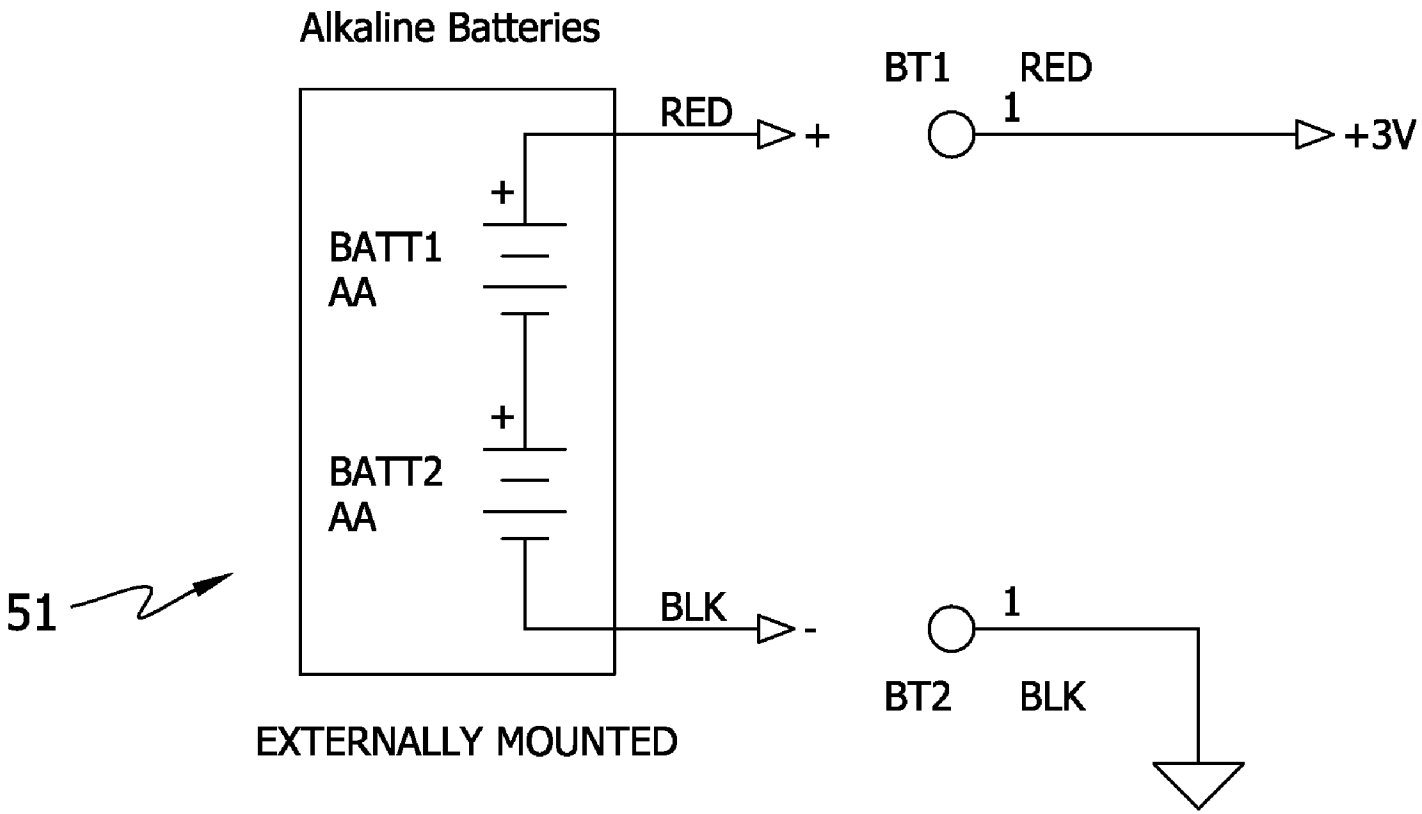

The power supply 51 of the apparatus 3 comprises a power source. In one embodiment, this power source comprises two standard 1.5VDC replaceable AA size batteries 201. The number of batteries can vary from one to two or more. The batteries of the power supply are received in recesses 205 in the inner surface of the outer shell 57 at opposite sides of the control board 161 (FIGS. 3-5). The batteries 201 are retained in proper position by springs 209 in the recesses 205. The necessary electrical connections between the components on the control board 161, the batteries 201 and the LED 43 are made by conductors (not shown), such as wiring suitably attached to the housing (e.g., by tape, glue, channels in the housing, etc.).

Alternatively, the battery or batteries can be re-chargeable and not replaceable by the user. Other power sources are possible.

The power supply 51 also includes a "boost" type LED driver 225 mounted on the control board 161 (FIG. 8). The driver 225 is used to power the light-emitting LED 43 at a current level up to 350 mA, for example. The brightness level of the LED is controlled by a pulse-width modulated (PWM) signal generated by the controller 175 at pin 5. The PWM signal is low-pass filtered by network R3/C2 so as to produce a dc voltage suitable for driving the CNTRL input (pin 8) of the LED driver 225. The current through LED is controlled by the dc voltage level present at pin 8 of the controller 175. The LED brightness level is controlled by a user-alterable parameter held within the microcontroller's flash memory. As will be described, the brightness level can be varied as needed to provide good visibility of the catcher's hand signals without being so bright as not to bring attention to the catcher.

FIGS. 9A-9D are segments of an electrical schematic showing an alternative circuit similar to that shown in FIGS. 8A-8D, and corresponding components are identified by corresponding numbers. It will be noted that, in FIGS. 9A-9D, the LED brightness portion of the circuit is replaced by software in the controller 49, and that the power on/off switch is eliminated. Instead, power is automatically provided by contacting the switch 181.

The switch 181 of the light-emitting apparatus performs multiple functions, including turning the power supply 51 on and off; setting the "active" zone in which the LED 43 is automatically illuminated; and adjusting the intensity or brightness of the light emitted by the LED. To activate the desired functions, the switch is manipulated through certain sequences.

For example, in one embodiment, the pushbutton switch 181 is depressed for a predetermined interval of time, e.g., longer than eight seconds, to turn the unit on. The light-emitting device 43 will turn on momentarily to indicate that the device has been powered-up. To turn the unit off, the switch is depressed for another interval of time, e.g., eight seconds.

To set the desired "active" zone in which the LED 43 will automatically illuminate, a catcher wearing the leg gear assumes an active catcher's position. The pushbutton 181 then is pressed for a different interval of time, e.g., two seconds, and released. The light-emitting device will blink two times, for example, indicating that the "active" zone has been set. This setting will remain until this procedure is repeated.

To set the brightness of the LED, the pushbutton 181 is depressed for an interval of time, e.g., four seconds, following which the LED flashes four times. When the pushbutton is released, the light-emitting LED will turn on to the previously-set brightness setting. There are a number of different brightness settings, e.g., four settings. Once the LED has turned on during this procedure, the user has a predetermined time interval, e.g., up to five seconds, to change the setting until the device returns to the normal or "run" mode. During this interval, the user can cycle through each of the brightness settings by depressing the pushbutton one time.

The light-emitting apparatus 3 also includes an automatic power-down feature if the sensor 47 fails to sense movement of the leg gear over a predetermined interval of time, such as when a catcher removes the leg gear without turning off the power supply. In such an event, the controller automatically sets the LED control signal at output pin 5 to logic '0'. This turns off the LED to conserve battery life.

It will be understood that the above time durations and sequences are exemplary only, and that other procedures may be used for activating the various functions of the unit.

Further, it is contemplated that the light-emitting apparatus can comprise a light-emitting device such as the LED 43 described above, and a simple on-off switch, e.g., a pushbutton, which can be manually operated by the catcher to turn the LED on and off as needed. In this embodiment, there is no sensor and no brightness-level adjustment.

Figure 10:
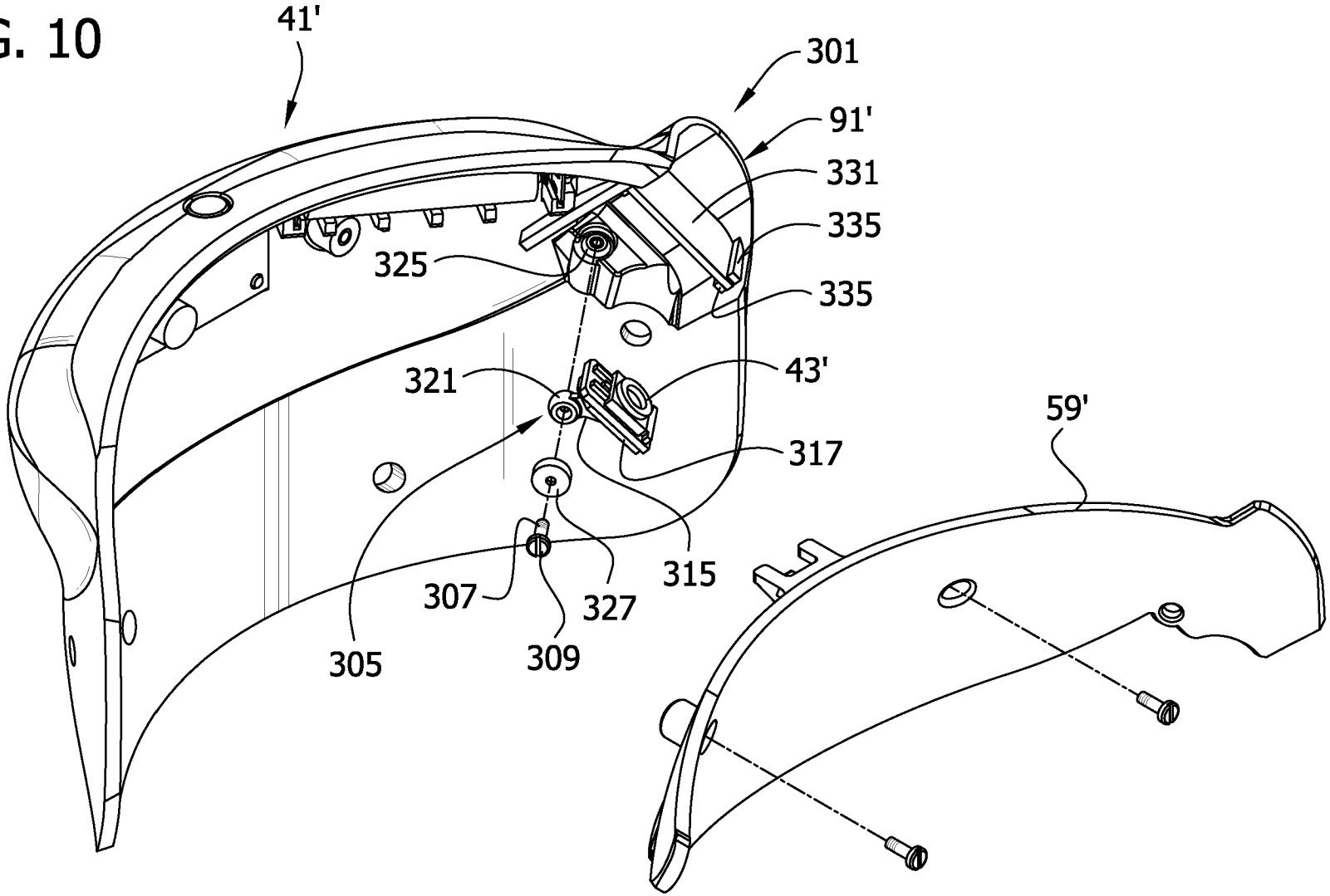
FIG. 10 is an exploded view showing a second embodiment of light-emitting apparatus of this invention.
Figure 11:
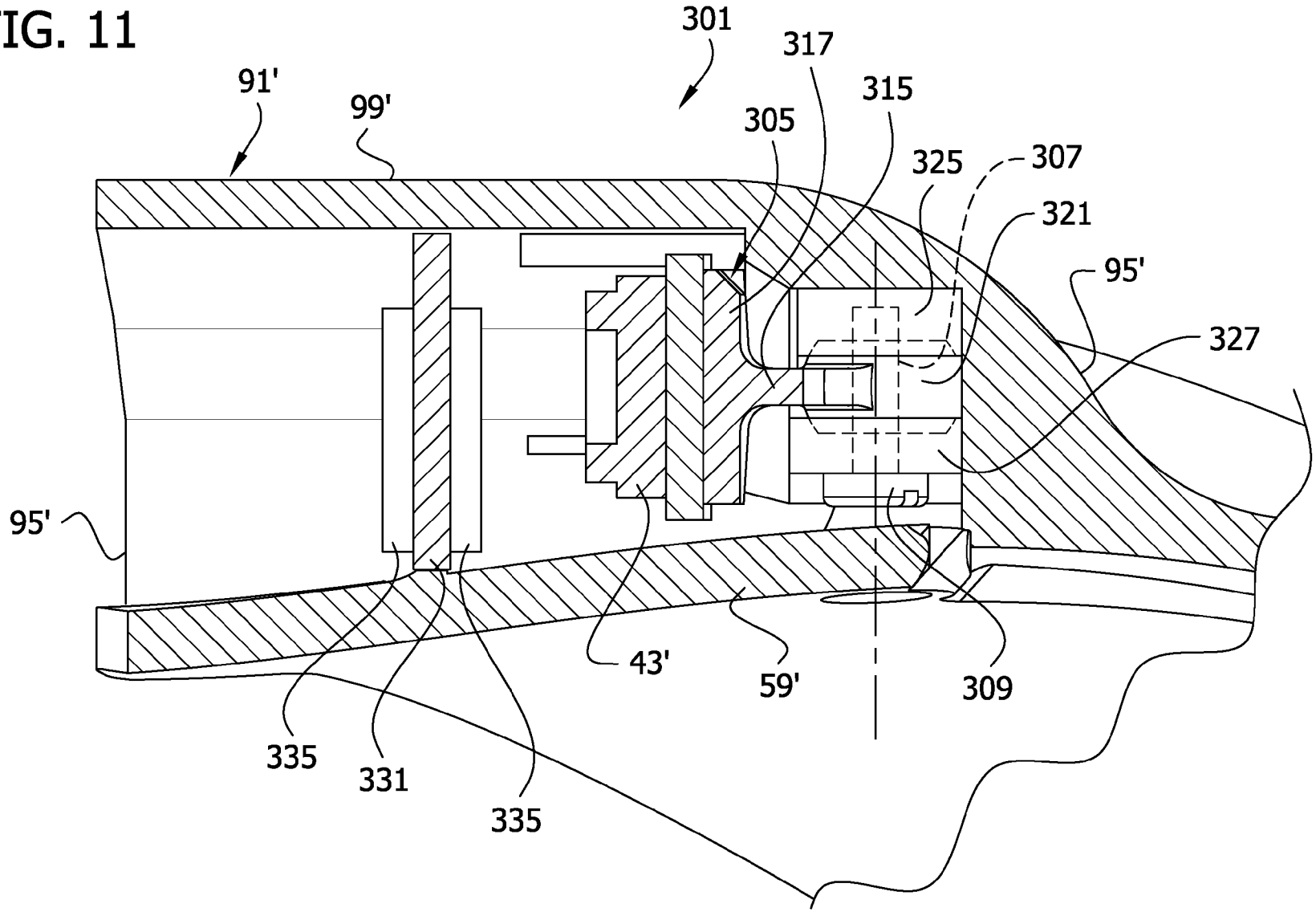
FIG. 11 is a sectional view of the alternative embodiment showing an LED-mounting arrangement.
Figure 12:
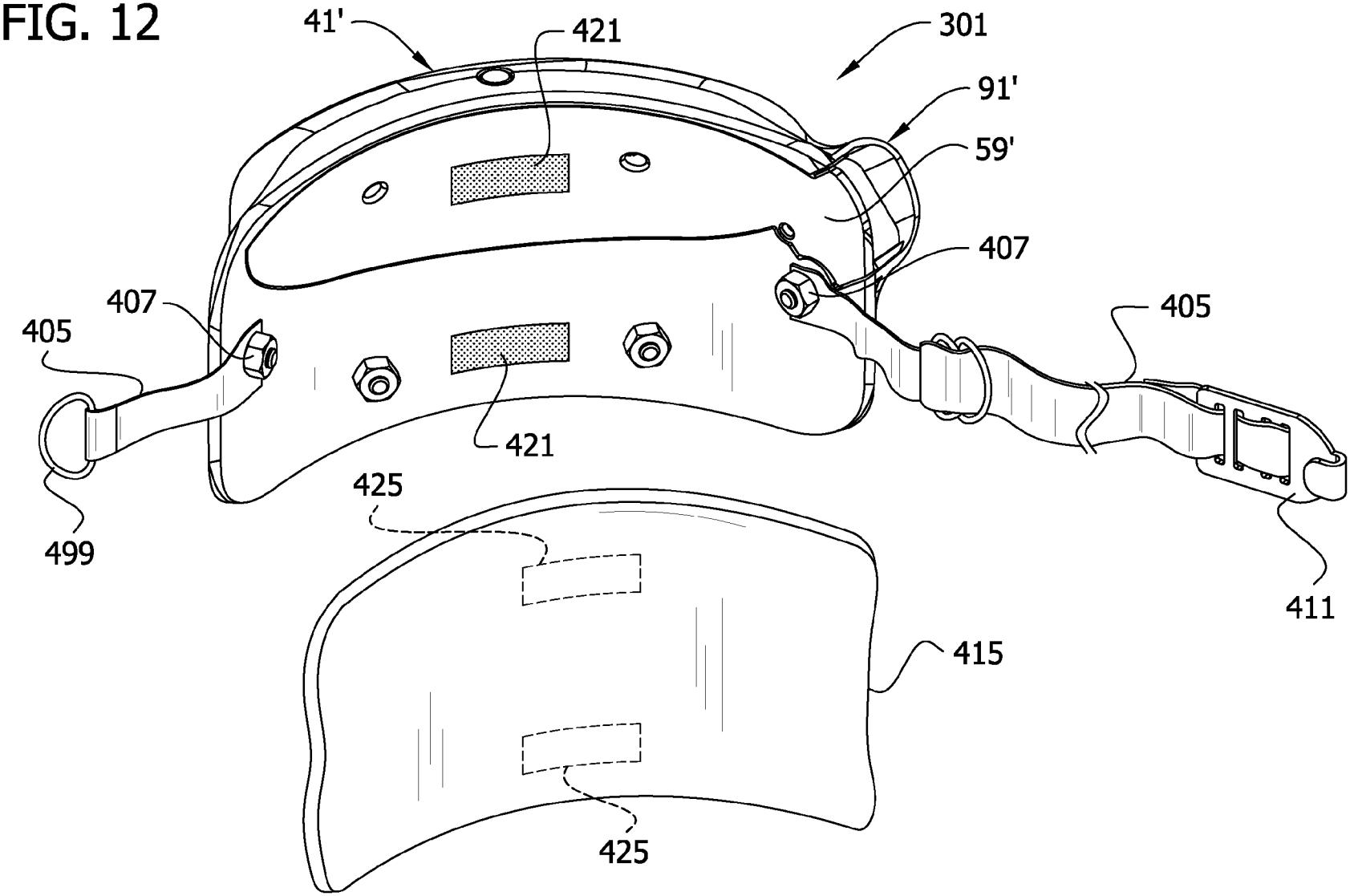
FIG. 12 is a rear view of the light-emitting apparatus of FIG. 10 equipped with straps for attaching the apparatus to the leg of a catcher.

FIGS. 10-12 illustrate an alternative light-emitting apparatus, generally designated 301. The apparatus 301 is similar to the light-emitting apparatus 3 of the preceding embodiment, and corresponding parts are designated by corresponding reference numbers with a prime (') designation. In this embodiment, the mount for the LED 43' comprises a pivot member 305 rotatable on a shaft 307 to permit manual adjustment of the LED so that light emitted by the LED is directed in the desired direction. In the illustrated embodiment, the shaft 307 is the shank of a bolt 309 secured to the hood 91'. The pivot member 305 comprises an arm 315 having a head 317 at one end for supporting the LED 43' and a part-spherical bushing 321 at its opposite end positioned between a bushing seat 325 and a removable washer 327 on the shaft 307. The bushing seat 325 and washer 327 are recessed to receive portions of the bushing 321 for rotation of the pivot member 305 on the shaft 317 of the bolt 309. Desirably, the bushing seat 325 is formed as an integral part of the hood 91' and is configured for threaded engagement with the threaded end of the bolt. The LED 43' is locked in adjusted position by tightening the bolt 309 to clamp the bushing 311 of the pivot member 305 against the bushing seat 325. The pivot member 305 is removable (e.g., to allow replacement of the LED 43') by unthreading the bolt 309 from the bushing seat 325, the slotted head of the bolt being accessible by unfastening and removing the inner lining 59' from the housing 41'. Light from the LED 43' is directed through a lens 331 held in place by supports 335 on the inside of the hood 91'. Other arrangements for mounting the light-emitting device are possible.

The light-emitting apparatus 3, 301 described above can be used in different ways. A first way is to incorporate the apparatus 3, 301 as an integral part of a leg guard at the time the leg guard is manufactured. A second way is to retrofit an existing leg guard with the apparatus 3, 301. This can be accomplished by using a suitable attachment device to attach the apparatus 3, 301 to a leg guard modified to receive the apparatus. The attachment can be permanent, e.g., by using rivets, or releasable, e.g., by using Velcro fasteners, snaps or other releasable fasteners. A third way of using the light-emitting apparatus 3, 301 is to equip the apparatus with an attachment device (e.g., one or more straps) for attaching the housing 41, 41' to a leg of the catcher independent of the other catching gear worn by the catcher. (As used herein, "independent" means that the housing 41, 41' can be attached to a leg even if there is no other catching gear on the leg at the time of attachment.) By way of example but not limitation, FIG. 12 shows an attachment device, generally designated 401, on the housing 41'. The device 401 comprises a pair of straps 405 secured to the housing by fasteners 407. The straps are configured for encircling the leg and may be secured in position around the leg by a conventional mechanism, such as a ring 409 and clip 411. Other attachment devices can be used. In one embodiment, a removable cushion 415 is attached to the back of the housing 41' by means of Velcro patches 421 on the housing and mating Velcro patches 425 on the cushion. The cushion 415 serves to protect the leg.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawing[s] shall be interpreted as illustrative and not in a limiting sense.

What is claimed is:

1. Catching gear to be worn by a catcher receiving a ball from a pitcher, said gear comprising a leg guard adapted to be worn on one leg of the catcher, and light-emitting apparatus comprising a light-emitting device on the leg guard positioned and operable to generate a beam of light directed in a generally rearward direction toward the catcher's fingers to increase the visibility of hand signals by the catcher to the pitcher when the catcher is in a crouch position wearing the leg guard, and a housing substantially shielding the light-emitting device from view.

2. Catching gear as set forth in claim 1 wherein said light-emitting apparatus comprises a control system for controlling the operation of said light-emitting device.

3. Catching gear to be worn by a catcher receiving a ball from a pitcher, said gear comprising a leg guard adapted to be worn on one leg of the catcher, and light-emitting apparatus comprising a light-emitting device on the leg guard positioned and operable to generate a beam of light in a generally rearward direction toward the catcher's fingers to increase the visibility of hand signals by the catcher to the pitcher when the catcher is in a crouch position wearing the leg guard, wherein said light-emitting apparatus comprises a control system for controlling the operation of said light-emitting device, and wherein said light-emitting apparatus further comprises a sensor for sensing an active zone of the catcher corresponding to said crouch position of the catcher, said control system being responsive to signals from the sensor for activating said light-emitting device when the catcher enters said active zone.

4. Catching gear as set forth in claim 3 wherein said sensor comprises an accelerometer.

5. Catching gear as set forth in claim 3 wherein said control system is programmed to turn the light-emitting device to On and Off positions according to a predetermined algorithm.

6. Catching gear as set forth in claim 5 wherein said algorithm comprises the steps of turning on the light-emitting device after the catcher has entered said active zone and turning off the light-emitting device after the catcher has moved out of said target zone.

7. Catching gear as set forth in claim 2 wherein said control system includes a mechanism for adjusting the brightness of the light-emitting device.

8. Catching gear as set forth in claim 2 wherein said light-emitting device is an LED device and said control system comprises a printed circuit board mounted on said leg guard.

9. Catching gear as set forth in claim 8 wherein said apparatus further comprises at least one replaceable battery.

10. Catching gear as set forth in claim 9 wherein said housing contains said LED device, printed circuit board and battery.

11. Catching gear as set forth in claim 2 wherein said control system is programmed to turn the light-emitting device on and off according to a predetermined algorithm.

12. Catching gear as set forth in claim 1 wherein the light emitted by the light-emitting device is white (natural color) light.

13. Catching gear as set forth in claim 1 wherein the light emitted by the light-emitting device is non-visible light.

14. Catching gear to be worn by a catcher receiving a ball from a pitcher, said gear comprising a leg guard adapted to be worn on one leg of the catcher, and light-emitting apparatus comprising a light-emitting device on the leg guard positioned and operable to generate a beam of light directed in a generally rearward direction toward the catcher's fingers to increase the visibility of hand signals by the catcher to the pitcher when the catcher is in a crouch position wearing the leg guard, wherein said light-emitting apparatus further comprises a housing on said leg guard for housing said light-emitting device, said housing including a hood overlying said light-emitting device for substantially shielding the light-emitting device from view when the catcher is in said crouch position wearing the leg guard, said hood having an opening through which light from the light-emitting device is directed in said generally rearward direction.

15. Catching gear as set forth in claim 14 wherein said housing comprises a substantially rigid outer shell, and wherein said hood is integrally formed as one piece with the outer shell.

16. Catching gear as set forth in claim 14 wherein said light-emitting apparatus further comprises a mount for adjustably mounting the light-emitting device on the housing, said mount being manually adjustable to vary the position of the light-emitting device and thus change the direction at which light from the light-emitting device is directed.

17. Catching gear as set forth in claim 16 wherein said mount comprises a swivel member mounted for swivel movement relative to the hood.

18. Catching gear as set forth in claim 16 wherein said mount comprises a pivot member mounted for rotation relative to the hood.

19. Light-emitting apparatus to be worn by a catcher receiving a ball from a pitcher, said light-emitting apparatus comprising a housing, a light-emitting device in or on the housing for generating light for increasing the visibility of hand signals by the catcher to the pitcher, and an attachment device for attaching the housing to a leg of the catcher or to a leg guard worn by the catcher such that the housing is in a position in which it substantially shields the light-emitting device from view and the light from the light-emitting device is emitted in a generally rearward direction toward the catcher's fingers to increase the visibility of hand signals by the catcher to the pitcher when the catcher is in a crouch position wearing said light-emitting apparatus.

20. Light-emitting apparatus as set forth in claim 19 wherein said attachment device comprises one or more straps on the housing adapted to encircle a leg of the catcher whereby the light-emitting apparatus may be secured the leg independent of any leg guard on the leg.

21. Light-emitting apparatus to be worn by a catcher receiving a ball from a pitcher, said light-emitting apparatus comprising a housing, a light-emitting device in or on the housing for generating light for increasing the visibility of hand signals by the catcher to the pitcher, an attachment device for attaching the housing to a leg of the catcher or to a leg guard worn by the catcher such that the housing is in a position in which the light from the light-emitting device is emitted in a generally rearward direction toward the catcher's fingers to increase the visibility of hand signals by the catcher to the pitcher when the catcher is in a crouch position wearing said light-emitting apparatus, a control system for controlling the operation of said light-emitting device, and a sensor for sensing an active zone of the catcher corresponding to said crouch position of the catcher, said control system being responsive to signals from the sensor for activating said light-emitting device when the catcher enters said active zone.

22. Catching gear as set forth in claim 1 wherein said leg guard comprises a thigh section, a knee section, a shin section, and hinge members connecting the sections allowing the sections to pivot relative to one another, said light emitting device being mounted on one of said sections.

23. Catching gear as set forth in claim 22 wherein said light-emitting device is mounted on said thigh section.

24. Light-emitting apparatus to be worn by a catcher receiving a ball from a pitcher, said light-emitting apparatus comprising a housing, a light-emitting device in or on the housing for generating light for increasing the visibility of hand signals by the catcher to the pitcher, an attachment device for attaching the housing to a leg of the catcher or to a leg guard worn by the catcher such that the housing is in a position in which the light from the light-emitting device is emitted in a generally rearward direction toward the catcher's fingers to increase the visibility of hand signals by the catcher to the pitcher when the catcher is in a crouch position wearing said light-emitting apparatus, wherein said housing includes a hood overlying said light-emitting device for substantially shielding the light-emitting device from view when the catcher is in said crouch position wearing said light-emitting apparatus, said hood having an opening through which light from the light-emitting device is directed in a generally rearward direction.

25. Light-emitting apparatus as set forth in claim 24 wherein said housing comprises a substantially rigid outer shell, and wherein said hood is integrally formed as one piece with the outer shell.

26. Light-emitting apparatus as set forth in claim 24 further comprising a mount for adjustably mounting the light-emitting device under the hood, said mount being manually adjustable to vary the position of the light-emitting device and thus change the generally rearward direction at which light from the light-emitting device is directed.

* * * * *